US012637313B2

(12) United States Patent
Choi et al.

(10) Patent No.: US 12,637,313 B2
(45) Date of Patent: May 26, 2026

(54) ROLL TYPE RAW MATERIAL SUPPLY DEVICE

(71) Applicants: LG ENERGY SOLUTION, LTD., Seoul (KR); DSK CO., LTD., Ansan-si (KR)

(72) Inventors: Dongsoon Choi, Daejeon (KR); Sang Don Lee, Daejeon (KR); Woong Ki Kim, Daejeon (KR); Doseong Han, Daejeon (KR); Won Jong Lee, Ansan-si (KR); Yook Il Jung, Ansan-si (KR); Young Mo Kwon, Ansan-si (KR)

(73) Assignee: LG ENERGY SOLUTION, LTD., Seoul (KR)

( * ) Notice: Subject to any disclaimer, the term of this patent is extended or adjusted under 35 U.S.C. 154(b) by 500 days.

(21) Appl. No.: 18/016,769

(22) PCT Filed: Apr. 15, 2022

(86) PCT No.: PCT/KR2022/005455

§ 371 (c)(1),
(2) Date: Jan. 18, 2023

(87) PCT Pub. No.: WO2022/220638

PCT Pub. Date: Oct. 20, 2022

(65) Prior Publication Data

US 2023/0286765 A1 Sep. 14, 2023

(30) Foreign Application Priority Data

Apr. 15, 2021 (KR) ..... 10-2021-0048933
Jan. 13, 2022 (KR) ..... 10-2022-0005009

(51) Int. Cl.
*B65H 19/10* (2006.01)
*B65H 16/02* (2006.01)
(Continued)

(52) U.S. Cl.
CPC ..... *B65H 19/10* (2013.01); *B65H 16/02* (2013.01); *B65H 19/102* (2013.01);
(Continued)

(58) Field of Classification Search
CPC .... B65H 19/10; B65H 19/102; B65H 19/105; B65H 19/107; B65H 20/16; B65H 20/18;
(Continued)

(56) References Cited

U.S. PATENT DOCUMENTS 3,501,104 A * 3/1970 Hellemans ..... H04Q 3/0004 242/532.2
4,543,152 A * 9/1985 Nozaka ..... B65H 19/1852 242/555.6

(Continued)

FOREIGN PATENT DOCUMENTS

CN 210167470 U 3/2020
CN 112186272 A 1/2021

(Continued)

OTHER PUBLICATIONS

JP2008184230A Translation; Sato et al.; Paper Splicing Device and Corrugating Machine; Published On: Aug. 14, 2008; Published by: Espacenet/WIPO (Year: 2008).*

(Continued)

*Primary Examiner* — Victoria P Augustine
*Assistant Examiner* — Raveen J Dias
(74) *Attorney, Agent, or Firm* — Birch, Stewart, Kolasch & Birch, LLP

(57) ABSTRACT

A roll type raw material supply device includes a raw material mounting unit for introducing a roll type raw material to which a tape for fixing to the end portion of a raw material is attached; a tape removal unit for clamping a non-bonding portion of the tape and separating the tape from the raw material; and a raw material conveying unit for
(Continued)

attaching and moving the raw material. The roll type raw material supply device is capable of automatically and effectively removing the tape attached to a roll type raw material and causing the end portion of the raw material to be moved to a desired location without damage such as warping.

12 Claims, 8 Drawing Sheets

(51) Int. Cl.
*B65H 16/04* (2006.01)
*B65H 16/10* (2006.01)
*B65H 20/16* (2006.01)

(52) U.S. Cl.
CPC ..... *B65H 19/105* (2013.01); *B65H 20/16* (2013.01); *B65H 16/04* (2013.01); *B65H 16/103* (2013.01); *B65H 2301/415095* (2013.01); *B65H 2301/4176* (2013.01); *B65H 2301/41766* (2013.01); *B65H 2301/521* (2013.01); *B65H 2405/50* (2013.01); *B65H 2405/575* (2013.01); *B65H 2405/58* (2013.01); *B65H 2405/581* (2013.01); *B65H 2515/60* (2013.01)

(58) Field of Classification Search
CPC ..... B65H 16/00; B65H 16/02; B65H 16/04; B65H 16/06; B65H 2301/41509; B65H 2301/415095; B65H 2301/521; B65H 2301/4176; B65H 2301/41764; B65H 2301/41766; B65H 2405/50; B65H 2405/57; B65H 2405/571; B65H 2405/573; B65H 2405/574; B65H 2405/575; B65H 2405/58; B65H 2405/581; B65H 2515/60; B65H 2553/412; B65H 5406/12; B65H 2406/122
See application file for complete search history.

(56) References Cited

U.S. PATENT DOCUMENTS 4,721,263 A * 1/1988 Miyazaki ..... A24C 5/20 242/562
4,840,320 A 6/1989 Shigeta et al.
4,848,691 A * 7/1989 Muto ..... B65H 19/29 156/506
5,096,134 A * 3/1992 Sakano ..... B65H 19/105 242/562.1
5,167,376 A * 12/1992 Boldrini ..... B65H 19/105 242/562
5,197,688 A 3/1993 Giorgio et al.
5,328,114 A * 7/1994 Boldrini ..... B65H 19/105 156/752
5,366,174 A * 11/1994 Tsukamoto ..... B65H 19/1878 156/763
5,383,622 A * 1/1995 Kohler ..... B65H 23/24 242/527.2
6,325,324 B1 * 12/2001 Getz ..... B65H 19/1873 242/555.2
6,805,765 B1 * 10/2004 Brandli ..... B65H 19/102 242/555.3
2001/0035248 A1 * 11/2001 Sato ..... B65H 19/105 156/364
2005/0139717 A1 * 6/2005 Eikmeier ..... B65H 19/102 242/555.3
2005/0263639 A1 * 12/2005 Takahashi ..... B65H 19/105 242/566
2006/0162852 A1 * 7/2006 Gertsch ..... B65H 19/102 156/267
2010/0104792 A1 * 4/2010 Rodriguez ..... B65H 19/102 428/40.1
2012/0211142 A1 * 8/2012 Casey ..... B26D 1/305 83/13
2017/0001823 A1 * 1/2017 Christensen ..... B65H 23/24
2017/0137251 A1 * 5/2017 Sato ..... B65H 20/12
2017/0158449 A1 * 6/2017 Kramer ..... B32B 43/006
2018/0105380 A1 * 4/2018 Tunioli ..... B65H 20/16
2018/0162668 A1 * 6/2018 Hong ..... B65H 19/102
2020/0255247 A1 * 8/2020 Ruhland ..... B65H 19/18
2022/0119214 A1 * 4/2022 Lucia ..... B65H 19/105
2022/0380158 A1 * 12/2022 Austin ..... B65H 19/2261
2023/0135675 A1 * 5/2023 Lee ..... H01M 4/04 156/751

FOREIGN PATENT DOCUMENTS

IN 10546/DELNP/2014 A 8/2015
JP 4-327466 A 11/1992
JP 5-105287 A 4/1993
JP 5-56856 U 7/1993
JP H0812181 A * 1/1996 ..... B65H 41/00
JP 9-194090 A 7/1997
JP 2002-274705 A 9/2002
JP 2021-174705 A 11/2002
JP 2005-298162 A 10/2005
JP 2008162781 A * 7/2008 ..... B65H 19/10
JP 2008-184230 A 8/2008
JP 2009-4218 A 1/2009
JP 2010-150008 A 7/2010
JP 2013-43660 A 3/2013
JP 2019-41051 A 3/2019
KR 10-0915269 B1 9/2009
KR 10-2014-0105960 A 9/2014
KR 10-2016-0133264 A 11/2016
KR 10-1695650 B1 1/2017
KR 10-1705191 B1 2/2017
KR 10-1832936 B1 2/2018
KR 10-2018-0068788 A 6/2018
KR 10-2018-0069390 A 6/2018
KR 10-1873198 B1 8/2018
KR 10-1892583 B1 8/2018
KR 10-2019-0124635 A 11/2019
KR 20190124635 A * 11/2019 ..... H01L 21/67126
KR 20190126051 A * 11/2019 ..... B65H 19/105
KR 10-2020-0042131 A 4/2020
KR 10-2020-0051053 A 5/2020
KR 10-2192068 B1 12/2020
KR 10-2021-0009009 A 1/2021
KR 10-2021-0029448 A 3/2021
KR 102326503 B1 * 11/2021 ..... B65H 19/105

OTHER PUBLICATIONS

JP2010150008A Translation; Kimura et al.; Extraction Method and Extraction Device for Trailing End of Hoop-Shaped Band Material; Published On: Jul. 8, 2010; Published by: Espacenet/WIPO (Year: 2010).*
International Search Report (PCT/ISA/210) issued in PCT/KR2022/005455 mailed on Jul. 25, 2022.
Extended European Search Report for European Application No. 22788493.9, dated Sep. 27, 2024.

* cited by examiner

【Figure 1】
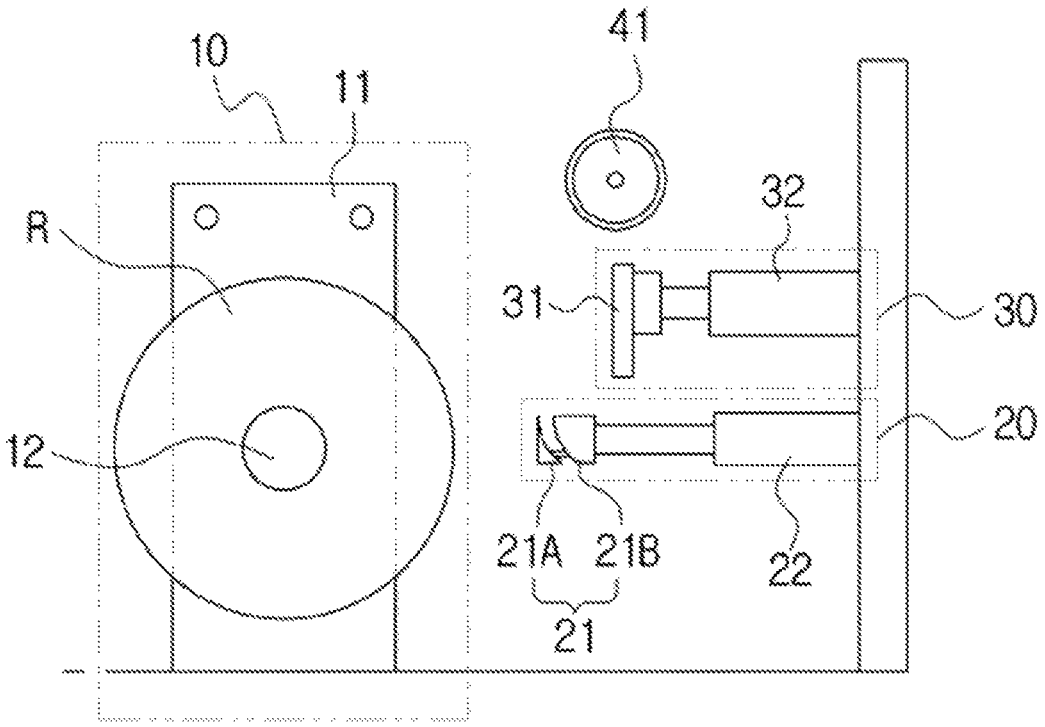
【Figure 2a】
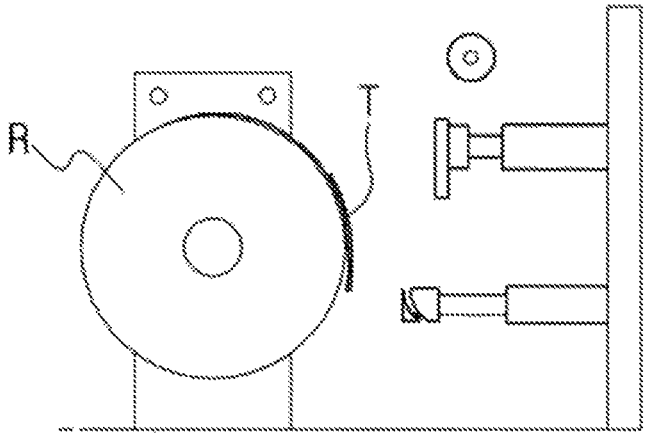

【Figure 2b】
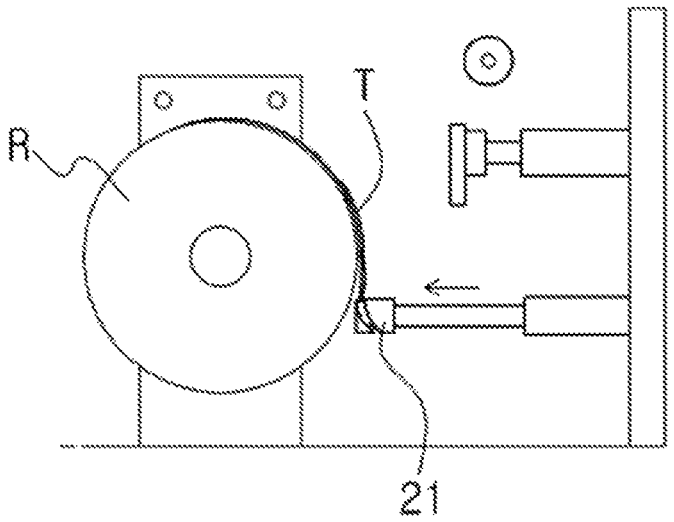
【Figure 2c】
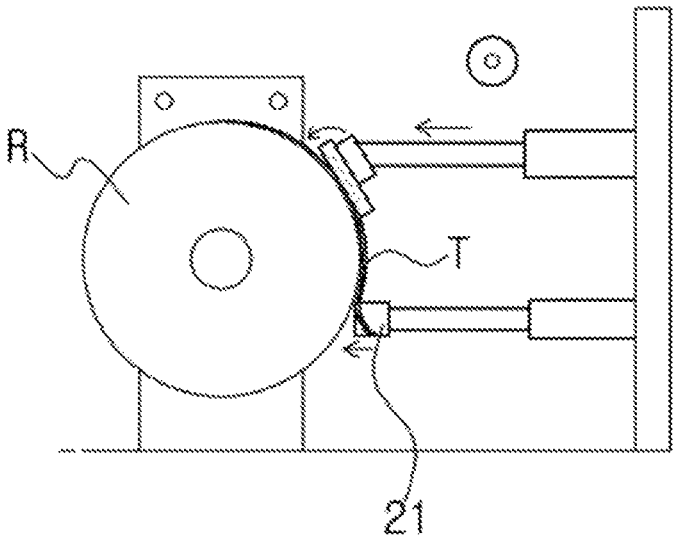

【Figure 2d】
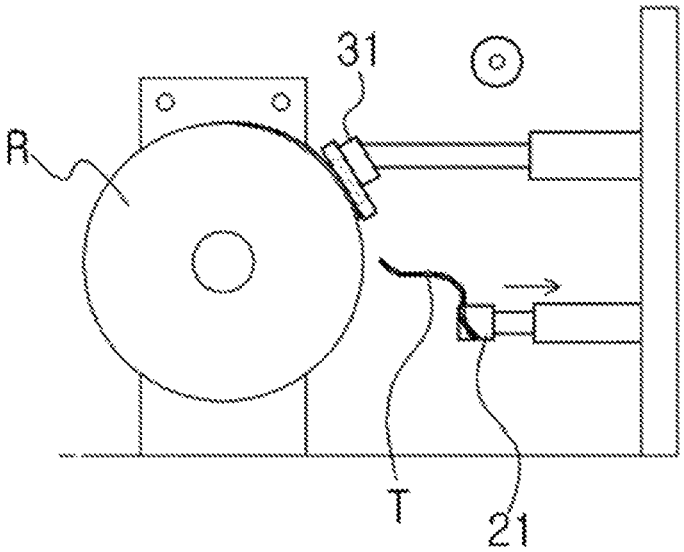
【Figure 2e】
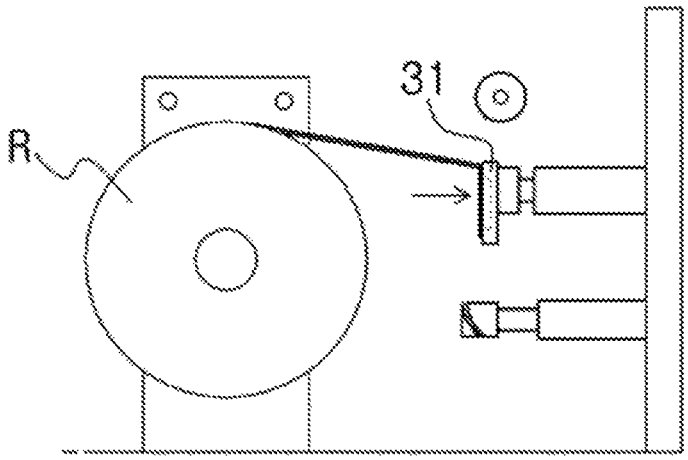

【Figure 2f】
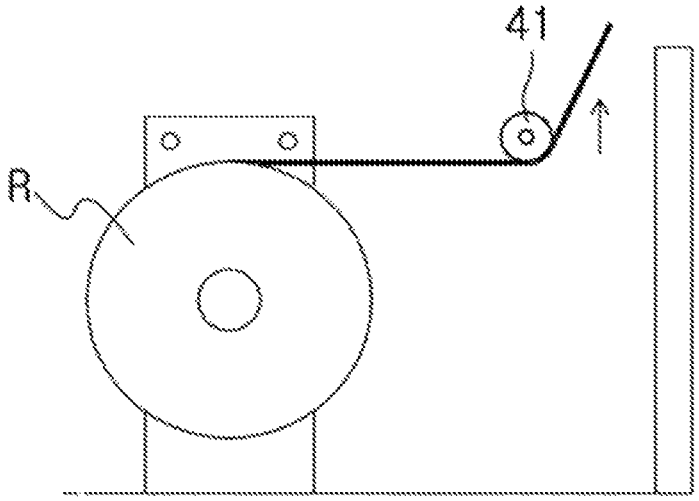
【Figure 3a】
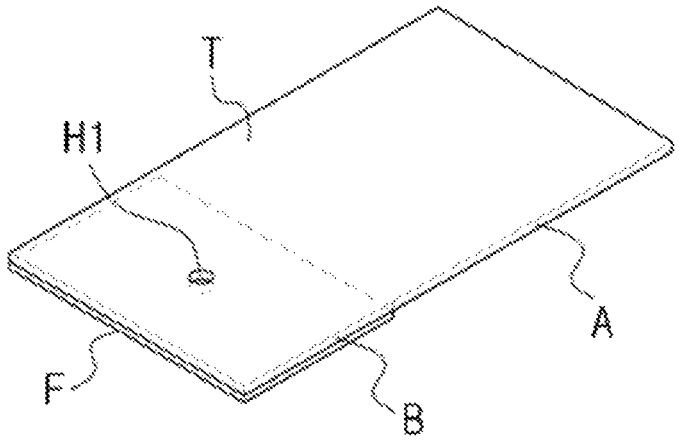

【Figure 3b】
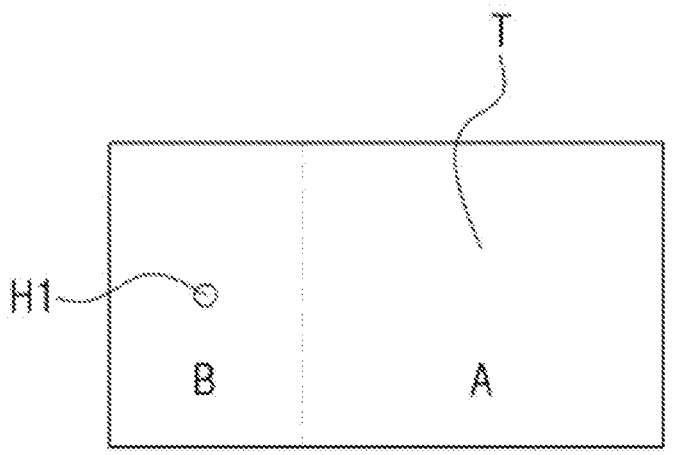
【Figure 4】
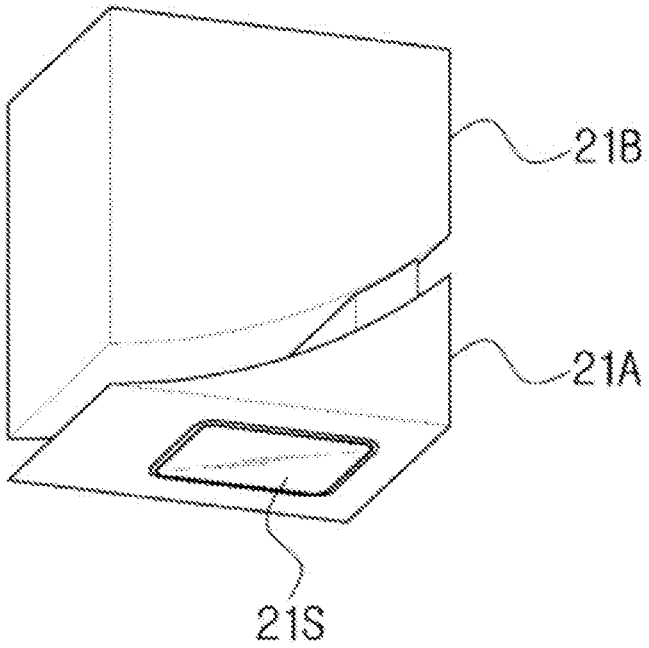

【Figure 5】
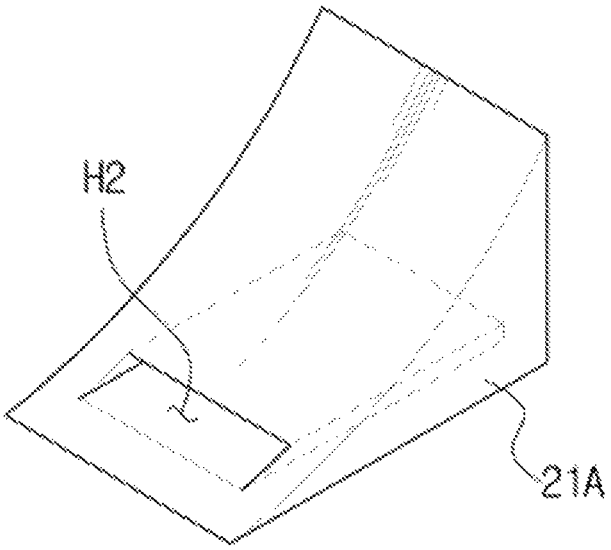
【Figure 6a】
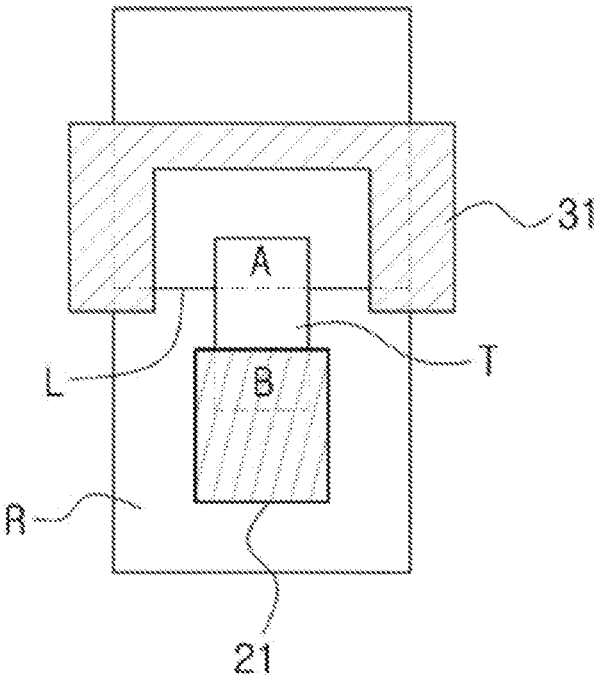

【Figure 6b】
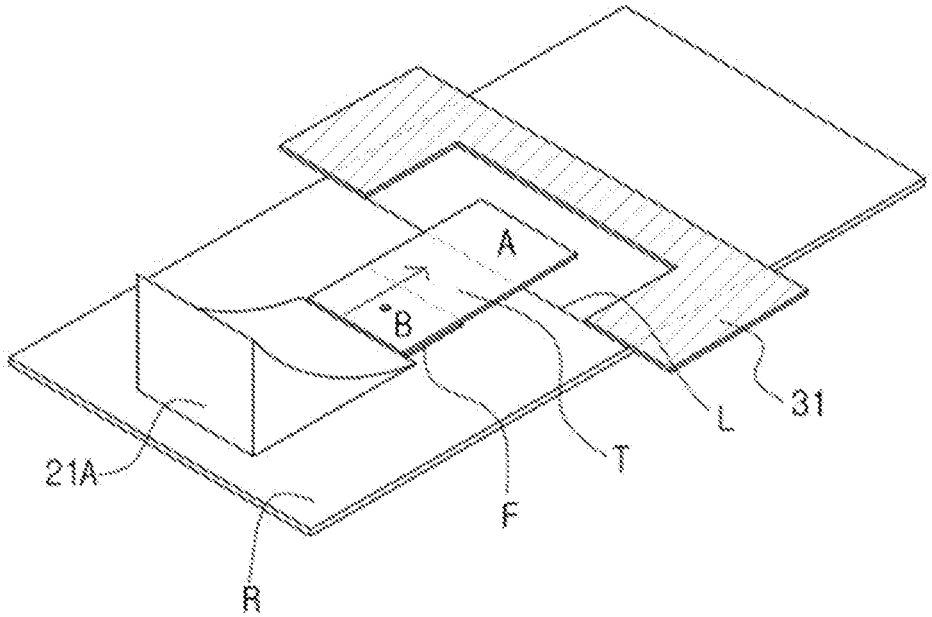
【Figure 7a】
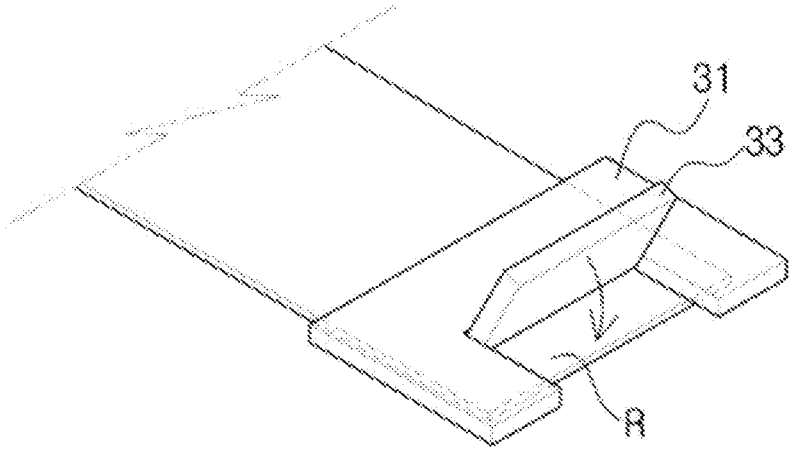

【Figure 7b】
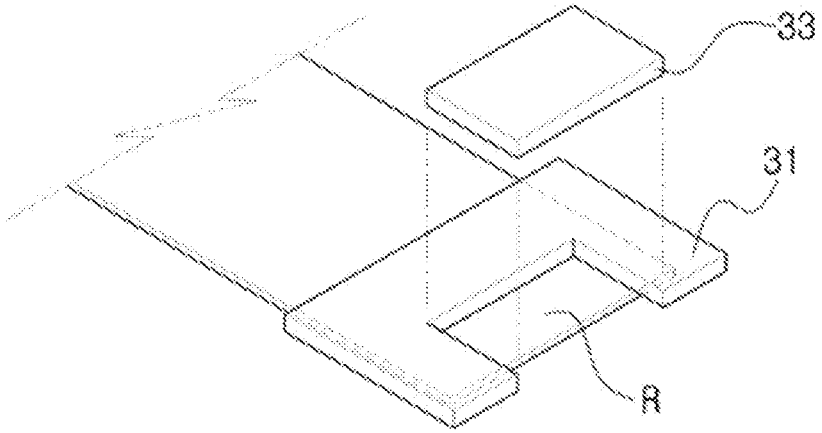
【Figure 8】
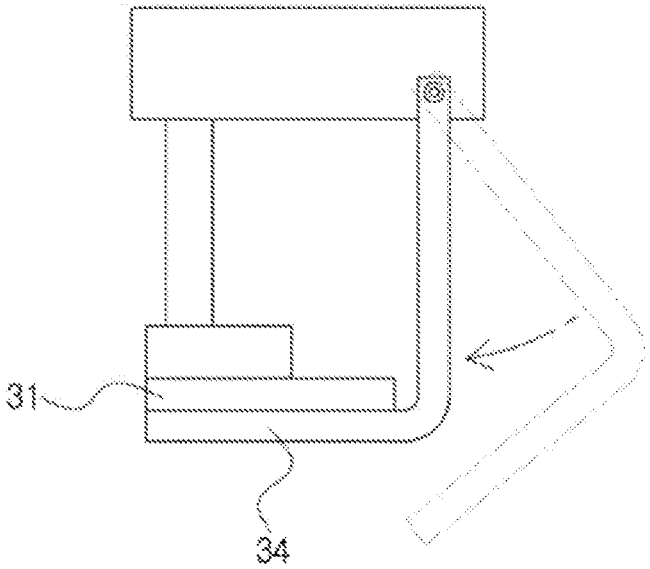

ROLL TYPE RAW MATERIAL SUPPLY DEVICE

TECHNICAL FIELD

The present invention relates to a roll type raw material supply device. This application claims the benefit of priority to Korean Patent Application No. 10-2021-0048933 filed on Apr. 15, 2021 and Korean Patent Application No. 10-2022-0005009 filed on Jan. 13, 2022, the entire contents of which are incorporated herein by reference.

BACKGROUND ART

A secondary battery is a chemical battery that can be used semi-permanently by continuously repeating charging and discharge using an electrochemical reaction, which is classified into a lead-acid battery, a nickel-cadmium battery, a nickel-hydrogen battery, and a lithium secondary battery. Among them, a lithium secondary battery has superior voltage and energy density characteristics compared to other batteries, thereby leading the market for secondary batteries, which is divided into a lithium-ion secondary battery using a liquid electrolyte and a lithium-ion polymer secondary battery using a solid electrolyte, according to the type of electrolyte. This lithium secondary battery is composed of a positive electrode, a negative electrode and an electrolyte, and also the separator is generally positioned between the positive electrode and the negative electrode to prevent a short circuit between the positive electrode and the negative electrode due to their direct contact.

In this separator, various resins comprising a polyolefin-based polymer resins such as polyethylene and polypropylene are used as raw materials, and the raw material is mainly supplied in the form of a roll. When supplying a new raw material due to the exhaustion of the raw material in use, in general, the raw material is continuously supplied by bonding the end portion of the raw material in use and the end portion of the new raw material. An automated bonding device that bonds the raw material in use and the new raw material is already known as a related art as in Patent Document 1 below. However, supplied raw material in the form of a roll is initially supplied by attaching a tape to an end portion so as to prevent the roll from unwinding, and there is inconvenience that the tape is manually removed and a part of the roll should be released and inserted into a raw material supply location of the automated bonding device in order to apply the supplied raw material in the form of a roll to the automated bonding device. Further, when the roll is released by the manual work, it is difficult to maintain a tension in the supplied raw material in the form of a roll as it is, and thus a quality of the raw material of the corresponding portion deteriorates.

Therefore, the present inventor studies the roll type raw material supply device capable of automating even a process of removing the tape in the supplied raw material in the form of a roll and supplying the supplied raw material in the form of a roll, corresponding to the automated bonding device, and has completed the present invention in order to solve the above-described problem.

PRIOR ART DOCUMENT

Patent Document (Patent Document 1) Korean Laid-open Patent Publication No. 10-2016-0133264

DISCLOSURE

Technical Problem

In order to solve the above problems, it is an object of the present invention to provide a roll type raw material supply device capable of automatically removing a tape attached to a raw material in the form of a roll and moving so as to supply the end portion of the raw material to a subsequent device.

Technical Solution

The present invention provides a roll type raw material supply device including: a raw material mount configured to support a roll type raw material R to which a tape is attached to an end portion of a raw material to temporarily fix the end portion; a tape remover configured to clamp a non-bonding portion of the tape and separate the tape from the raw material; and a raw material conveyor configured to attach and move the raw material.

In one embodiment of the present invention, the raw material mount includes a support and a first roller, wherein the support supports the first roller, and the first roller fixes and rotates the roll type raw material.

In one embodiment of the present invention, the tape remover includes a clamp assembly and a first conveying cylinder, wherein the clamp member includes a first clamp member and a second clamp member, and the first clamp member is located between the second clamp member to movable into contact with the raw material and the tape when operating the roll type raw material supply device, and when the first clamp member and the second clamp member are spaced apart from each other and then the nonbonding portion B of the tape is positioned between the first clamp member and the second clamp member, the first clamp member and the second clamp member are configured to be movable close to each other to clamp the non-bonding portion of the tape, and the first conveying cylinder is configured to move the clamp assembly.

In one embodiment of the present invention, the raw material conveyor includes an attachment pad and a second conveying cylinder, wherein the attachment pad is configured to attach to and to fix the end portion of the raw material, and the second conveying cylinder is configured to move the attachment pad.

In one embodiment of the present invention, the non-bonding portion of the tape attached to the roll type raw material has a different color from the raw material and is coated with a film having greater rigidity than the tape, and the first clamp member includes a color sensor configured to identify the film.

In one embodiment of the present invention, the first clamp member includes an air configured to direct air towards the tape to separate the non-bonding portion of the tape from the roll type raw material.

In one embodiment of the present invention, a portion of the tape that is coated with the film has one or more holes through which air can pass.

In one embodiment of the present invention, the attachment pad has a shape in which an attachment surface is configured to contact a corner of the end portion of the raw material and to not in contact with the tape when the attachment pad is attached to and fixes the end portion of the raw material.

In one embodiment of the present invention, the raw material conveying further includes a supplementary member configured to be used in combination with the attachment pad 31 so that an attachment surface of the supplementary member and the attachment surface of the attachment pad are contactable across an entire width of the end portion of the raw material after the tape is removed.

In one embodiment of the present invention, the raw material conveyor further includes a support configured to support the end portion of the raw material such that the end portion of the raw material is located between the support member and the attachment surface when unwinding the roll type raw material after attaching the raw material.

In one embodiment of the present invention, the roll type raw material supply device further includes one or more second roller configured to adjust a tension of the raw material and to define a movement path of the raw material.

Advantageous Effects

The roll type raw material supply device according to the present invention can automatically and effectively remove the tape attached to a roll type raw material, and can cause the end portion of the raw material to move to a desired location without damage such as warping.

DESCRIPTION OF DRAWINGS

FIG. 1 is a view schematically showing the roll type raw material supply device according to an embodiment of the present invention.

FIGS. 2*a*, 2*b*, 2*c*, 2*d*, 2*e*, and 2*f* are views sequentially showing a process in which a roll type raw material supply device is driven according to an embodiment of the present invention.

FIGS. 3*a* and 3*b* are views showing a tape in which a non-bonding portion is coated with a film according to an embodiment of the present invention. FIG. 3*a* is a perspective view and FIG. 3*b* is a plan view.

FIG. 4 is a view showing a clamp member including a color sensor according to an embodiment of the present invention.

FIG. 5 is a view showing a clamp member including an air eruption hole according to an embodiment of the present invention.

FIG. 6*a* is a plan view showing a state in which the clamp member and an attachment pad are in contact with a roll type raw material just before removing a tape according to an embodiment of the present invention. FIG. 6*b* is a perspective view showing a state in which a first clamp member is in contact with a raw material before clamping a non-bonding portion of the tape according to an embodiment of the present invention.

FIGS. 7*a* and 7*b* are views showing a raw material conveying unit including a supplementary member according to an embodiment of the present invention.

FIG. 8 is a view showing a raw material conveying unit including a support member according to an embodiment of the present invention.

BEST MODE

The terms and words used in the present specification and claims should not be construed as limited to ordinary or dictionary terms, and should be construed in a sense and concept consistent with the technical idea of the present invention, based on the principle that the inventor can properly define the concept of a term to describe his invention in the best way possible. Therefore, since the configuration shown in the embodiments and drawings described in the present specification is only one of the most preferred embodiments of the present invention, and does not represent all of the technical spirit of the present invention, it should be understood that various equivalents and modifications may be substituted for them at the time of filing the present application.

In the drawings, the size of each component or a specific part constituting the component is exaggerated, omitted, or schematically illustrated for convenience and clarity of description. Therefore, the size of each component does not fully reflect the actual size. If it is determined that a detailed description of a related known function or configuration may unnecessarily obscure the gist of the present invention, such description will be omitted.

The present invention relates to a roll type raw material supply device, and in order to describe such a device, FIG. 1 provides a view schematically showing a roll type raw material supply device according to an embodiment of the present invention.

The roll type raw material supply device according to an embodiment of the present invention may include a raw material mounting unit 10, a tape removal unit 20, and a raw material conveying unit 30, and may include additional components as necessary.

The raw material mounting unit 10 is a device for introducing a roll type raw material R, and a tape (not shown in FIG. 1) for fixing to the end portion of the raw material is attached to the roll type raw material so as to prevent the roll from unwinding. Here, the "end portion" means the area from a start line (or end line) in the direction (when applied to a device, a machine direction (MD)) of a raw material R, to a line spaced apart by a certain distance and the certain distance is determined by the line in the width direction (when applied to the device, a transverse direction (TD)), where the attachment pad 31 and the raw material R are in contact with each other. The width of the tape is sufficient as long as the roll does not unwind, and may be much shorter than the width of the raw material. One tape is attached to a portion around a center of the width of the raw material. The raw material mounting unit 10 includes a support 11 and a first roller 12, and may include additional components as necessary. The support 11 is a device for supporting a first roller 12 so that the roll type raw material R may be introduced into the first roller. The first roller 12 is a device for fixing and rotating the roll type raw material R.

The raw material R may be supplied while one or more layers of fabrics are rolled in a roll type. When the raw material R is formed of two or more layers of fabrics, the fabric may be a state in which respective layers are attached by an electrostatic attraction. When conveying the raw material R formed of two or more layers of fabrics, it is advantageous to apply in subsequent processes only when the raw material R is conveyed in a state in which each layer is not separated from each other.

The tape removal unit 20 is a device for clamping the non-bonding portion of the tape and separating the tape from the raw material. The tape removal unit 20 may include a clamp member 21 and a first conveying cylinder 22, and may include additional components as necessary. The clamp member 21 is a device for clamping the non-bonding portion of the tape. The clamp member 21 includes a first clamp member 21A and a second clamp member 21B, wherein the first clamp member 21A is positioned at the outer side than the second clamp member 21B, and is in contact with the raw material R and the tape when driving the device. When the first clamp member 21A and the second clamp member 21B are spaced apart from each other and then the non-bonding portion of the tape is positioned between the first clamp member 21A and the second clamp member 21B, the first clamp member 21A and the second clamp member 21B are in contact with each other to clamp the non-bonding portion of the tape. The first conveying cylinder 22 is a device for moving the clamp member 21. The first conveying cylinder 22 may achieve the purpose of removing the tape only by causing the clamp member 21 to contact the roll type raw material R and move in a direction away from the roll type raw material (a left-right direction in FIG. 1), but it also causes the clamp member 21 to move in a direction perpendicular thereto (an up-down direction in FIG. 1) if necessary.

The raw material conveying unit 30 is a device for attaching and moving the raw material. The raw material conveying unit 30 includes an attachment pad 31 and a second conveying cylinder 32. The attachment pad 31 is a device for attaching and fixing the end portion of the raw material. The attachment pad 31 attaches and fixes the end portion of the raw material, thereby effectively removing only the tape in a state in which the clamp member 21 fixes the end portion of the raw material, and supplying the raw material to a desired location by causing the attachment pad 31 to move to unwind the roll. The attachment pad 31 may attach the raw material through adsorption or electrostatic force. When the raw material R is formed of two or more layers of fabrics, the attachment pad 31 may fix the raw material R in a state in which each layer of the fabrics is attached using electrostatic force, thereby conveying the raw material R in a state in which each layer is not separated from each other. An electrostatic chuck may be used in order to apply the electrostatic force, and if the raw material R may be fixed in a state in which each layer of the fabrics is attached, the type of electrostatic chuck is not particularly limited. According to one embodiment of the present invention, the electrostatic chuck includes a polyimide substrate and a bi-polar type electrode, and is driven by applying a voltage of 1.0 kV to 5.0 kV, specifically 1.5 kV to 4.0 kV, and more specifically 2.0 kV to 3.0 kV. Two or more layers of fabrics may be efficiently fixed within the above range.

The second conveying cylinder 32 is a device for moving the attachment pad 31. The second conveying cylinder 32 causes the attachment pad 31 to be in contact with the roll type raw material R and move in a direction away from the roll type raw material R (the left-right direction in FIG. 1), and also causes the attachment pad 31 to move in a direction perpendicular thereto (the up-down direction in FIG. 1) in order to supply the raw material to a desired location. As the second conveying cylinder 32, a 2-axis direction orthogonal robot, which is movable in both an X direction (the left-right direction in FIG. 1) and a Z direction (the up-down direction in FIG. 1) except for a Y direction (a front-rear direction in FIG. 1), may be used, and when the 2-axis orthogonal robot moves in the Y direction, a warping phenomenon of the raw material may occur. The roll type raw material supply device according to an embodiment of the present invention further includes one or more second rollers 41. The second rollers 41 are a device for adjusting the tension of the raw material and deciding a movement path of the raw material. In the roll type raw material supply device, the second rollers 41 are disposed in the middle of the movement path of the raw material, thereby preventing a phenomenon in which the tension of the raw material is decreased at a specific portion according to a supply speed of the raw material. The tension of the raw material may be controlled by installing a load cell in the second roller 41, and the warping phenomenon or a break phenomenon of the raw material may be prevented by controlling the tension of the raw material.

In order to specifically describe a process of separating a tape from a roll type raw material and causing the end portion of the raw material to move to a location required for a subsequent step, FIG. 2 provides a view showing a process in which a roll type raw material supply device is driven sequentially according to an embodiment of the present invention.

As shown in FIG. 2*a*, the clamp member 21 of the tape removal unit 20 moves to a vicinity of the roll type raw material R to identify a location of a tape T from the roll type raw material R which rotates in a counterclockwise direction. Thereafter, as shown in FIG. 2*b*, when the location of the tape T is identified, the location of the roll is adjusted so that the clamp member 21 may be positioned just below the non-bonding portion of the tape, and then the clamp member 21 is in contact with the roll type raw material R. Thereafter, as shown in FIG. 2*c*, the roll type raw material is rotated in a clockwise direction so that the non-bonding portion of the tape is positioned between the first clamp member 21A and the second clamp member 21B of the clamp member 21, and when the non-bonding portion of the tape is positioned between the first clamp member 21A and the second clamp member 21B of the clamp member 21, the second clamp member 21B is moved close to the first clamp member 21A so that the clamp member 21 clamps the non-bonding portion of the tape. Further, the attachment pad 31 moves to the end portion of the raw material to attach and fix the end portion of the raw material. In this case, since the attachment pad 31 is not in contact with the tape, the attachment pad 31 does not interfere with removal of the tape. As shown in FIG. 2*d*, the clamp member 21 is spaced apart from the roll type raw material to remove the tape T. Thereafter, as shown in FIG. 2*e*, the attachment pad 31 is spaced apart from the roll type raw material R to unwind the roll and move the end portion of the raw material. Thereafter, as shown in FIG. 2*f*, when the second roller 41 is present, the attachment pad 31 is moved so that the raw material moves in contact with the second roller 41.

In order to increase the efficiency of removing the tape, the tape coated with the film may be used. FIGS. 3*a* and 3*b* provide views showing a tape in which a non-bonding portion is coated with a film according to an embodiment of the present invention. FIG. 3*a* is a perspective view showing a state in which the tape is viewed obliquely and FIG. 3*b* is a plan view showing a state in which the tape is viewed from the top.

Since a generally used tape is transparent, even though the tape is attached to the roll type raw material, the roll type raw material shows the same color as the raw material in appearance even at a location to which the tape is attached, equally at a location to which the tape is not attached. Therefore, the location of the tape may not be easily distinguished visually. If the tape is coated with a film F having a different color from the raw material, the location of the tape may be easily distinguished visually. In an automated device, the film F having the different color is identified by a sensor such as color sensor. As shown in FIGS. 3*a* and 3*b*, the tape T is separated into a bonding portion A and a non-bonding portion B. The non-bonding portion B of the tape T is a portion where there is no bonding force on the surface that is in contact with the raw material, and when the tape T has the non-bonding portion B, the clamp member 21 of the device may easily clamp the tape T. The non-bonding portion B of the tape T is coated with the film F. A lower portion of the non-bonding portion B facing the raw material may also be coated with the film, and an upper portion of the non-bonding portion B, which is an opposite surface thereto, may be coated with the film, and the upper and lower portions of the non-bonding portion B may be coated with the film. Since a transparent tape or a translucent tape is used, there is no problem in identifying the film by the sensor even though the lower portion of the non-bonding portion B is coated with the film, and since a material of the film F may be rather lower in electrostatic attraction with the raw material R than the material of the tape T, it may be more advantageous in separating the non-bonding portion B of the tape from the roll type raw material R. When only the non-bonding portion B is coated with the film F by distinguishing the bonding portion A and the non-bonding portion B, it is easy for the sensor of the device to recognize the size of the non-bonding portion B and decide a location for the clamp member 21 to clamp the tape T. As the film F, a material having larger rigidity than the tape T may be used, and for example, a material such as polyethylene terephthalate (PET) may be used. When the material having the large rigidity is used as the film F, the non-bonding portion may be easily raised at once. A thickness of the film may be 10 to 500 μm, and preferably 50 to 200 μm. A portion coated with the film in the tape may have one or more holes H1 through which air may pass. The hole H1 may reduce the phenomenon in which the raw material and the non-bonding portion are in close contact with each other by the electrostatic attraction, and when the non-bonding portion B of the tape T is spaced apart from the roll type raw material R by artificially blowing the wind, the air passes between the holes H1, thereby preventing the non-bonding portion B of the tape T from excessively separating beyond a space between the first clamp member 21A and the second clamp member 21B.

In order to describe the location for the color sensor, FIG. 4 provides a view showing the clamp member including the color sensor according to an embodiment of the present invention.

When the film F having the different color is attached to the non-bonding portion B of the tape T, the clamp member 21 may include a color sensor 21S in order to recognize the location of the film F and adjust the location of the clamp member 21, and the color sensor 21S may be positioned on a surface facing the roll type raw material R of the first clamp member 21A or the tape T in order for the color sensor 21S to be effectively operated. If the film F may be identified with a high sensitivity, the type of color sensor 21S is not particularly limited.

In order to describe the location for the air eruption hole, FIG. 5 provides a view showing the clamp member including the air eruption hole according to an embodiment of the present invention.

In the case of the roll type raw material R and the non-bonding portion B of the tape T, even though the non-bonding portion B has no bonding force, the phenomenon in which the raw material R and the non-bonding portion B are in close contact with each other by the electrostatic attraction may occur, and when artificially blowing the wind to the space between the roll type raw material R and the non-bonding portion B, the non-bonding portion B may be easily spaced apart from the roll type raw material R. The wind may be generated by erupting the air from an air eruption hole H2 positioned in the clamp member. The air eruption hole H2 is connected to a device (not shown) that injects the air. In order to effectively separate the non-bonding portion B, it may be preferable that the air eruption hole H2 is formed to be close to the non-bonding portion B of the tape T in the first clamp member 21A as possible as shown in FIG. 5.

In order to describe a state in which the clamp member and the attachment pad are in contact with the roll type raw material just before removing the tape, FIG. 6*a* provides a plan view showing a state in which the clamp member and the attachment pad are in contact with the roll type raw material just before removing the tape according to an embodiment of the present invention, and FIG. 6*b* provides a perspective view showing a state in which the first clamp member is in contact with the raw material before clamping the non-bonding portion of the tape according to an embodiment of the present invention.

In general, one tape T is attached to the vicinity of a width center of the roll type raw material R, and the tape is bonded so that the bonding portion A goes through a start line L of the roll type raw material. In order to remove the tape, first, as shown in FIG. 6*b*, the first clamp member 21A is in contact with the roll type raw material R in the state of being adjacent to the end of the non-bonding portion of the tape, the first clamp member 21A moves toward the non-bonding portion B of the tape and is placed at a lower end of the first clamp member as shown in FIG. 6*a*, and the non-bonding portion B of the tape is positioned between the first clamp member and the second clamp member. Just before removing the tape, the first clamp member 21A among the clamp members 21 is in contact with the roll type raw material R in the state in which the clamp member 21 clamps the non-bonding portion B of the tape T, and the attachment pad 31 is in contact with the roll type raw material R in order to clamp the roll type raw material R so that the roll type material R is not unwound. In this case, in order to effectively remove the tape by separating the clamp member 21, it is important that the attachment pad 31 is not in contact with the tape. The shape of the attachment surface of the attachment pad 31 is not particularly limited as long as the roll type raw material R is not unwound and is not in contact with the tape, but covering the periphery of the tape as much as possible can prevent the deformation of the raw material at most by removing the tape. In addition, since the attachment pad 31 serves to prevent the roll type raw material from unwinding when removing the tape and also move the end portion of the raw material, if the attachment pad 31 clamps a corner of the end portion of the raw material, the phenomenon in which the corner is bent while moving may be prevented. In FIG. 6, one exemplary shape of the attachment pad 31 is presented, and in such a shape, the attachment pad 31 is in contact with the corner of the end portion of the raw material and is not in contact with the tape.

In order to describe the supplementary member, FIGS. 7*a* and 7*b* provide view showing the raw material conveying unit including the supplementary member according to an embodiment of the present invention.

Since the attachment pad 31 serves to clamp the raw material so as to prevent the roll type raw material from unwinding when removing the tape, the attachment pad 31 has a shape in which the attachment pad 31 is not in contact with the tape. The attachment pad 31 does not cover the entire area of the end portion of the raw material due to such a shape, and this causes a problem in that when the attachment pad 31 moves the end portion of the raw material, the end portion of the raw material is not sufficiently fixed. The raw material conveying unit 30 may further include a supplementary member 33, and the supplementary member 33 supplements the attachment pad 31 so that the attachment surface is in contact with the entire area of the end portion of the raw material after the tape is removed. Since the area to be supplemented is determined, the shape of the supplementary member 33 is not diversified, but the supplementary member 33 may be applied in various directions. FIGS. 7*a* and 7*b* present an exemplary application direction of the supplementary member 33.

In order to describe the support member, FIG. 8 provides a view showing the raw material conveying unit including the support member according to an embodiment of the present invention.

The support member 34 may be introduced to solve a problem in that the support member 34, similarly to the supplementary member 33, does not sufficiently fix the end portion of the raw material when the attachment pad 31 moves the end portion of the raw material, and the supplementary member 33 and the support member 34 may also be simultaneously applied. The raw material conveying unit 30 may further include the support member 34, and the support member 34 supports the other surface of the attachment surface when unwinding the roll type raw material R after attaching the raw material. When the supplementary member 33 and the support member 34 are simultaneously applied, since the supplementary member 33 may be applied before unwinding the roll type raw material R, the supplementary member 33 may be applied earlier than the support member 34. FIG. 8 presents an exemplary shape and an exemplary application direction of the support member 34.

In the above, although the present invention has been described with reference to limited embodiments and drawings, the present invention is not limited thereto, and also it is apparent that various modifications and variations can be made by those of ordinary skill in the art to which the present invention pertains within the scope of equivalents of the technical spirit of the present invention and the claims to be described below.

DESCRIPTION OF SYMBOL

10: Raw material mounting unit, 11: Support
12: First roller, 20: Tape removal unit
21: Clamp member, 21A: First clamp member
21B: Second clamp member, 21S: Color sensor
22: First conveying cylinder, 30: Raw material transport unit
31: Attachment pad, 32: Second conveying cylinder
33: Supplementary member, 34: Support member
41: Second roller, R: Roll type raw material
L: Start line (of roll type raw material), T: Tape
A: Bonding portion of tape, B: Non-bonding portion of tape (film coating portion)
F: Film, H1: Hole (of tape)
H2: Air eruption hole

The invention claimed is:

1. A roll type raw material supply device, the device comprising:

a raw material mount configured to support a roll type raw material to which a tape is attached to an end portion of a raw material to temporarily fix the end portion;

a tape remover configured to clamp a non-bonding portion of the tape and to separate the tape from the raw material; and a raw material conveyor configured to attach and move the raw material, wherein the raw material conveyor is disposed on a side opposite to the tape remover with respect to the end portion of the raw material prior to separating the tape from the raw material, and the raw material conveyor being disposed above the tape remover.

2. The roll type raw material supply device of claim 1, wherein the raw material mount comprises a support and a first roller, wherein the support is configured to support the first roller, and wherein the first roller is configured to fix and rotate the roll type raw material.

3. The roll type raw material supply device of claim 1, wherein the raw material conveyor comprises an attachment pad and a second conveying cylinder, wherein the attachment pad is configured to attach to and to fix the end portion of the raw material, and wherein the second conveying cylinder is configured to move the attachment pad.

4. The roll type raw material supply device of claim 3, wherein the attachment pad has a shape in which an attachment surface thereof is configured to contact a corner of the end portion of the raw material but not contact the tape when the attachment pad is attached to and fixes the end portion of the raw material.

5. The roll type raw material supply device of claim 4, wherein the raw material conveyor further comprises a supplementary member configured to be used in combination with the attachment pad so that an attachment surface of the supplementary member and the attachment surface of the attachment pad are contactable across an entire width of the end portion of the raw material after the tape is removed.

6. The roll type raw material supply device of claim 5, wherein the raw material conveyor further comprises a support member configured to support the end portion of the raw material such that the end portion of the raw material is located between the support member and the attachment surfaces of the attachment pad and the supplementary member when unwinding the roll type raw material after attaching the raw material.

7. The roll type raw material supply device of claim 4, wherein the raw material conveyor further comprises a support member configured to support the end portion of the raw material such that the end portion of the raw material is located between the support member and the attachment surface of the attachment pad when unwinding the roll type raw material after attaching the raw material.

8. The roll type raw material supply device of claim 3, further comprising one or more second rollers configured to adjust the tension of the raw material and to determine a movement path of the raw material.

9. A roll type raw material supply device, the device comprising:

a raw material mount configured to support a roll type raw material to which a tape is attached to an end portion of a raw material to temporarily fix the end portion;

a tape remover configured to clamp a non-bonding portion of the tape and to separate the tape from the raw material; and a raw material conveyor configured to attach and move the raw material, wherein the raw material conveyor is disposed on a side opposite to the tape remover with respect to the end portion of the raw material prior to separating the tape from the raw material, wherein the tape remover comprises a clamp assembly and a first conveying cylinder, wherein the clamp assembly comprises a first clamp member and a second clamp member, wherein the first clamp member is located between the second clamp member and the roll type material, such that the first clamp member is movable into contact with the raw material and the tape when operating the roll type raw material supply device, wherein, when the first clamp member and the second clamp member are spaced apart from each other and then the non-bonding portion of the tape is positioned between the first clamp member and the second clamp member, the first clamp member and the second clamp member are configured to be movable close to each other to clamp the non-bonding portion of the tape, and wherein the first conveying cylinder is configured to move the clamp assembly.

10. The roll type raw material supply device of claim 9, wherein the non-bonding portion of the tape attached to the roll type raw material has a different color from the raw material and is coated with a film having greater rigidity than the tape, and wherein the first clamp member comprises a color sensor configured to identify the film.

11. The roll type raw material supply device of claim 10, wherein the first clamp member comprises an air hole configured to direct air towards the tape to separate the non-bonding portion of the tape from the roll type raw material.

12. The roll type raw material supply device of claim 11, wherein a portion of the tape coated with the film has one or more holes through which air is capable of passing.

* * * * *